US005842288A

United States Patent [19]

Laseke et al.

[11] Patent Number: 5,842,288

[45] Date of Patent: *Dec. 1, 1998

[54] CLOTHES DRYER WITH CHIMING ALARM

[75] Inventors: Timothy Laseke, New Berlin; Spencer C. Schantz, Dousman, both of Wis.

[73] Assignee: U.S. Controls Corporation, New Berlin, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 763,024

[22] Filed: Dec. 10, 1996

[51] Int. Cl.[6] ..... F26B 13/10

[52] U.S. Cl. ..... 34/524; 34/526; 34/527; 340/384.6; 340/384.3; 368/255; 368/250

[58] Field of Search ..... 34/524, 526, 527; 340/384.6, 384.3; 368/255, 250, 245, 244

[56] References Cited

U.S. PATENT DOCUMENTS

| | | | |
|---|---|---|---|
| 3,599,342 | 8/1971 | Cotton | 34/393 |
| 3,783,529 | 1/1974 | Miller et al. | 34/527 |
| 4,213,121 | 7/1980 | Learn et al. | 340/384 |
| 4,401,975 | 8/1983 | Ferguson et al. | 340/384 |
| 4,437,088 | 3/1984 | Ferguson | 340/384 |
| 4,697,932 | 10/1987 | Matievic | 368/255 |
| 4,827,627 | 5/1989 | Cardoso | 34/526 |
| 4,980,669 | 12/1990 | Knowles | 340/474 |
| 5,398,024 | 3/1995 | Knowles | 340/474 |

*Primary Examiner*—Henry A. Bennett
*Assistant Examiner*—Pamela A. Wilson
*Attorney, Agent, or Firm*—Quarles & Brady

[57] ABSTRACT

A solid state alarm for a clothes dryer receives a line voltage signal prior to termination of the tumbling cycle to provide a series of pulses with decaying amplitudes driving a piezoelectric-type transducer. A timer terminating the series of pulses communicates with a pulse generating oscillator so as to eliminate partial pulsing at the conclusion of the alarm signal.

8 Claims, 2 Drawing Sheets

CLOTHES DRYER WITH CHIMING ALARM

BACKGROUND OF THE INVENTION

The present invention relates to clothes dryers having alarms indicating that the clothes are dry, and in particular to a low cost, solid state alarm for such clothes dryers.

BRIEF SUMMARY OF THE INVENTION

Clothes dryers operate by tumbling damp clothes in a rotating drum while dry air is passed through the drum. The tumbling better exposes the clothes to the drying air and prevents wrinkles from setting into the fabric, such as may occur if the clothes are allowed to settle.

Many dryers provide an alarm tone to signal the user that the tumbling is about to stop. The user may then remove the clothes before wrinkles set.

Typically, the alarm used by such dryers is an electromechanical buzzer. The advantages of an electromechanical buzzer are that it is of low cost and may be driven directly by a line voltage signal available from the dryer console. Unfortunately, the sound produced by the buzzer is considered harsh by some.

Accordingly there is interest in finding an alternative alarm suitable for use in a clothes dryer. Such an alarm must be inexpensive to produce, readily adapted to the line voltage environment of a clothes dryer, and ideally would produce a tone that is both pleasing and readily distinguished from other household appliances.

The present invention provides a low cost, solid-state alarm for a clothes dryer, replacing the previously used electromechanical buzzer. The alarm system uses a piezoelectric element operated to produce a series of pulses with decaying amplitude providing an effect of a chiming bell. Low cost circuitry has been developed compatible with the line voltage signals available in conventional clothes dryers.

Specifically, the present invention provides an alarm for a clothes dryer, the clothes dryer having a dryer basket in which clothes are tumbled during a tumbling cycle. The clothes dryer includes a cycle timer controlling the duration of the tumbling cycle, and a clothes dry signal generator providing an alarm voltage prior to the conclusion of the tumbling cycle. A transducer control circuit receives the alarm voltage and produces a predetermined number of audio frequency pulses having decaying amplitudes. The pulses are received by a piezoelectric transducer to produce a set of chiming tones.

Thus, it is one object of the invention to provide a alternative low cost alarm for use in a dryer that produces a pleasant but distinctive tone. The chiming effect clearly distinguishes the dryer alarm tone from other piezoelectric tones used in household appliances, and importantly, from the warning tones produced by smoke alarms and the like.

The piezoelectric transducer may include a piezoelectric element in a resonator housing, the piezoelectric element having a free air, natural, resonant frequency and the housing when assembled with the piezoelectric element, providing a cavity having a resonant frequency different from the free air resonant frequency of the piezoelectric element.

It is thus another object of the invention to further differentiate the tone produced by the clothes dryer from conventional piezoelectric tones. By tuning the cavity in which the piezoelectric element is placed to a different frequency than the piezoelectric element, the tone is further distinguished.

The transducer control circuit may include a pulse generating oscillator providing a series of audio frequency pulses to the piezoelectric transducer, and a pulse limiting timer deactivating the pulse generating oscillator after the predetermined number of pulses. The pulse limiting timer monitors the pulse generating oscillator to deactivate the pulse generating oscillator between pulses, eliminating partial pulses.

Thus it is another object of the invention to provide an inexpensive circuit suitable for use in a clothes dryer that eliminates partial alarm pulses. The use of a timer, instead of, for example, a counter, reduces the cost of implementing the present circuit, but raises the possibility that a partial pulse will be created when the pulse limiting timer deactivates the oscillator during the middle of a pulse. Such partial pulses may erroneously be interpreted as a malfunction or may sound like another device such as a smoke alarm. In the present invention, partial pulses are eliminated by electrical communication between the pulse limiting timer and the pulse generating oscillator to coordinate the deactivation of the pulse generating oscillator to occur after a pulse.

The foregoing and other objects and advantages of the invention will appear from the following description. In this description, reference is made to the accompanying drawings which form a part hereof and in which there is shown by way of illustration, a preferred embodiment of the invention. Such embodiment does not necessarily represent the full scope of the invention, however, and reference must be made therefore to the claims for interpreting the scope of the invention.

DETAILED DESCRIPTION OF THE INVENTION

Figure 1:
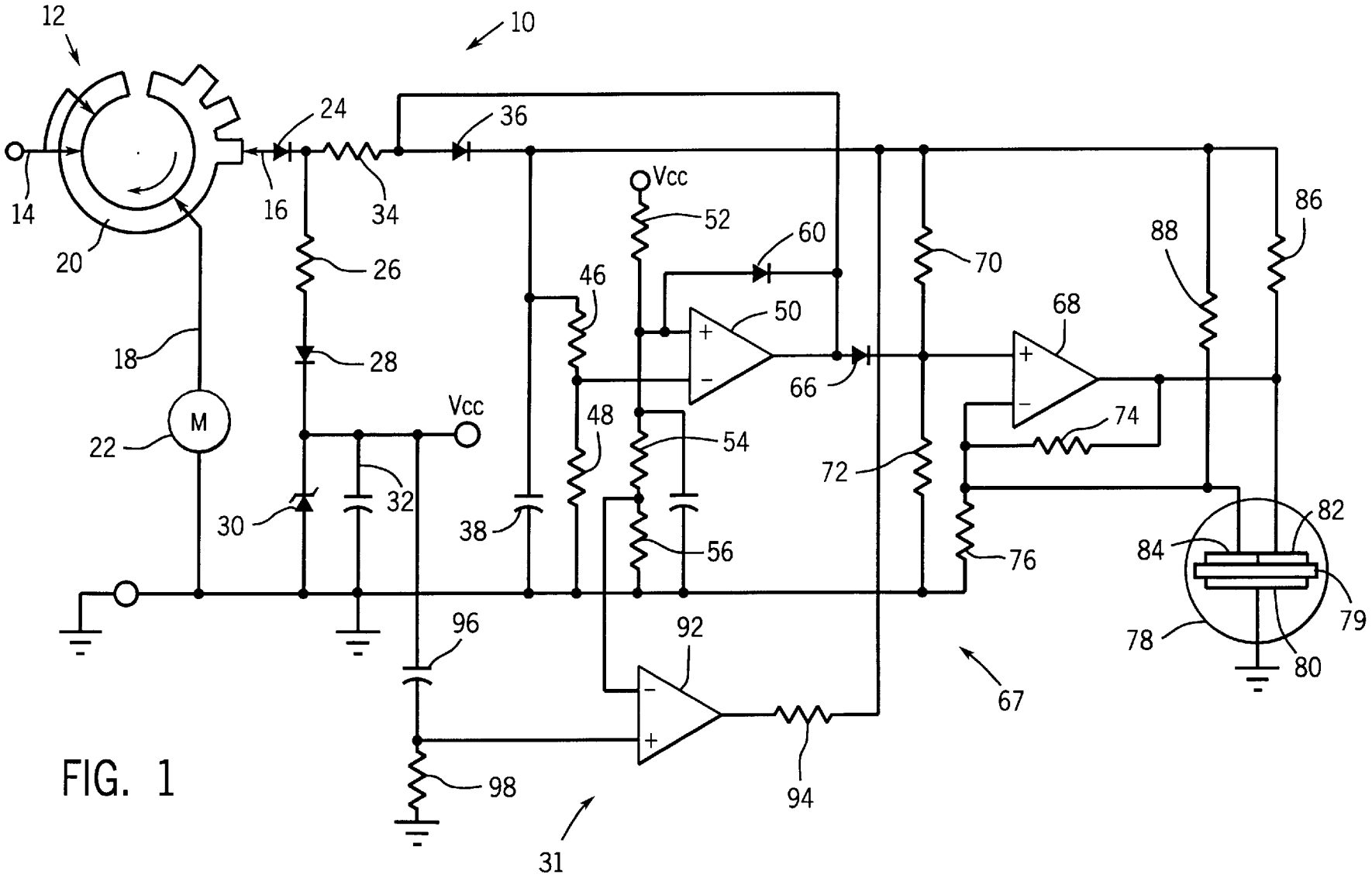
FIG. 1 is a schematic diagram of the circuit of the present invention.

Referring to FIG. 1, the alarm 10 of the present invention is connected to a rotary dryer control 12 having a connection to line voltage 14 ending tumble voltage at line 18 and providing an alarm voltage at terminal 16 and tumble voltage at terminal 18 at different times during a drying cycle. The tumble voltage remains on for the entire dryer cycle and provides power to a motor 22 which causes a tumbling of the clothes within a drum of the dryer (not shown). In contrast, the alarm voltage is provided only near the end of the dryer cycle prior to disconnection of the motor 22 from the line voltage 14 and is intended to provide a warning to the user that the motor and hence tumbling of the clothes will soon be stopped.

The rotary dryer control 12 is of conventional design well understood to those of ordinary skill in the art and provides the alarm and tumbling signals at terminals 16 and 18 through one or more annular conductive rings 20 rotated about their centers by a timer motor (not shown). The rings 20 are cut so as to connect and disconnect pairs of wiping contacts, one of each pair connected to the line voltage 14 and one each pair connected to either terminal 16 or 18 of the alarm voltage or tumble voltage, respectively.

When the line voltage 14 is connected to terminal 16, power flows during positive half cycles of the line frequency through a diode 24 to provide a half-wave rectified DC signal at the cathode of diode 24.

This half-wave rectified signal passes through limiting resistor 26 and forward through blocking diode 28 to the cathode of a zener diode 30, the latter of which is shunted by filter capacitor 32. The anode of the zener diode 30 is connected to ground.

The zener diode 30 has a breakdown voltage of thirty volts and thus provides at its cathode a regulated thirty-volt power supply designated $V_{cc}$ such as is used to provide power to the operational amplifiers 50, 68, and 92, to be described below, and to a pulse limiting timer 31 also to be described.

The half-wave rectified voltage from the diode 24 is also received by a second limiting resistor 34, which is in turn connected to the anode of second blocking diode 36. The cathode of blocking diode 36 connects to one side of a timing capacitor 38 the other side of which is connected to ground.

Pulse Generating Oscillator

Figure 2:
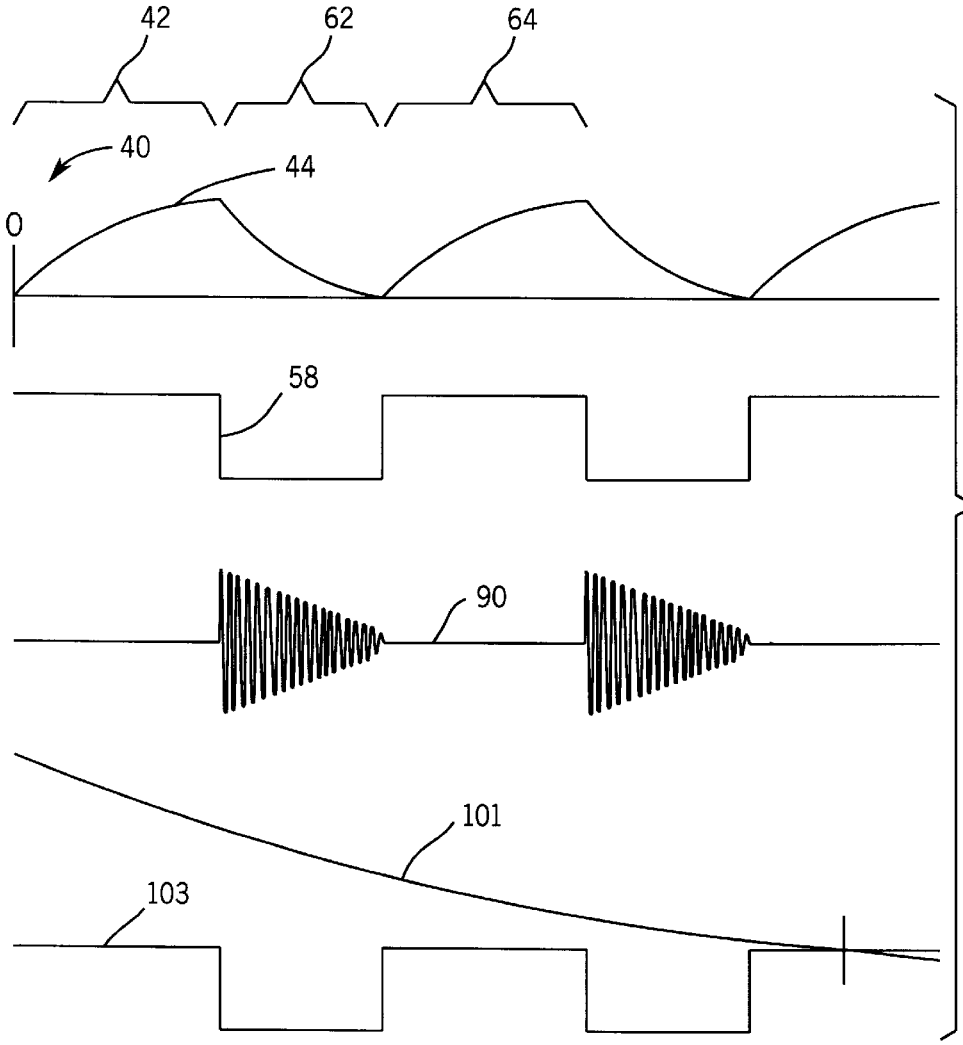
FIG. 2 is a set of graphs plotting voltage versus time for particular points in the circuit of FIG. 1.

Referring now also to FIG. 2, at a time 40 when the alarm voltage at terminal 16 is first received, the voltage on the capacitor 38 will rise during period 42 as indicated by waveform 44 as charge is accumulated on capacitor 38 from diode 36. The capacitor 38 is shunted by series connected resistors 46 and 48 which provide at their common junction a fraction of the waveform 44 to the inverting input of a first operational amplifier 50.

The non-inverting input of the operational amplifier 50 connects to a second voltage divider formed by three series connected resistors 52, 54, and 56. Resistor 52 has one end connected to $V_{cc}$ and the other end connected to a resistor 54. The remaining end of resistor 54 is connected to resistor 56 which is also connected to ground. Resistors 54 and 56 are shunted by a small capacitor intended to reduce the effect of noise on the switching of operational amplifier 50.

Generally, as the voltage of the inverting input of the operational amplifier 50 (a reduced version of waveform 44) rises above the voltage established at the junction of resistors 52 and 54, the output of the operational amplifier 50 will swing from positive to a value near ground as indicated by waveform 58. This negative going transition of the output of operational amplifier 50 marks the conclusion of period 42 and the beginning of period of 62.

When the output of operational amplifier 50 nears ground, it forward biases a feedback diode 60, this diode having its cathode connected to the output of the operational amplifier 50 and its anode connected to the non-inverting input of the operational amplifier 50. Feedback diode 60 thus provides a high degree of hysteresis in the switching action of operational amplifier 50 which operates in a comparator mode. As a result, a significant drop in the voltage on capacitor 38 is required before operational amplifier 50 will switch again to a high output, indicated in FIG. 2 at the conclusion of period 62.

The output of operational amplifier 50 is also connected to the juncture of resistor 34 and diode 36 so that at the conclusion of period 42, when the output of the operational amplifier 50 is near ground, the anode of diode 36 is pulled to ground, stopping the charging of capacitor 38. Capacitor 38 then begins to discharge through shunting resistors 46 and 48. When capacitor 38 has suitably discharged (i.e., to within one diode drop of ground), the output of operational amplifier 50 rises again as indicated by waveform 58 during period 64.

Audio Signal Oscillator

A second operational amplifier 68 is used to produce an audio signal to drive a piezoelectric element 79 during period 62 according to the pulse signals provided by operational amplifier 50.

In this regard, the operational amplifier 68 receives a biasing voltage on its non-inverting input provided by series connected resistors 70 and 72, joined together at the non-inverting input of operational amplifier 68 with resistor 70 connected from the non-inverting input to the cathode of diode 36 and resistor 72 connected from the non-inverting input to ground. The values of resistor 70 and 72 are equal so as to bias the non-inverting input of operational amplifier 68 at about midway between ground and the supply voltage from diode 36.

The inverting input of operational amplifier 68 is connected to the output of operational amplifier 68 through a feedback resistor 74 and is also connected to ground through a resistor 76.

The output of the operational amplifier 68 is also connected to a piezoelectric transducer 78. Piezoelectric transducer 78, which is well understood in the art, provides on a first surface of a piezoelectric element 79, a ground electrode 80 and on a second, obverse surface of a piezoelectric element 79, a driving electrode 82 and feedback electrode 84. Driving electrode 82 is connected directly to the output of operational amplifier 68 and also to a pull-up resistor 86, the latter having its other end connected to the cathode of diode 36. Feedback electrode 84 is connected to the inverting input of operational amplifier 68 and also to pull-up resistor 88 which has its other end connected to the cathode of diode 36.

The property of feedback electrode 84 is to produce a signal, caused by flexure of the transducer disk under the influence of voltage on driving electrode 82, the signal being out of phase with the voltage on the driving electrode 82. Thus, as fed back to the operational amplifier 68, the signal from electrode 84 provides positive feedback causing the piezoelectric transducer 78 to oscillate under the influence of its connections with operational amplifier 68 at a natural frequency of the piezoelectric transducer 78.

When the output of operational amplifier 50 is in its low state, indicated by period 62 of waveform 58, a connecting diode 66 having its anode connected to the output of operational amplifier 50 and its cathode connected to the non-inverting input of operational amplifier 68 is back biased, essentially disconnecting operational amplifier 50 from operational amplifier 68. Thus, at the beginning of period 62, the piezoelectric transducer 78 may begin oscillating at an audio frequency of approximately 22 kilohertz as driven by operational amplifier 68. When the output of operational amplifier 50 rises again during period 64, it forward biases diode 66 forcing the inverting input of operational amplifier 68 high, thus overriding the feedback signals from the piezoelectric transducer 78 and causing it to cease oscillating.

The oscillating signal produced by the output of operational amplifier 68, shown as waveform 90 in FIG. 2, has an amplitude dependent on the voltage at the cathode of diode 36. Because this latter voltage is decaying during period 62 as indicated by waveform 44 of FIG. 2, an envelope of the oscillating signal 90 is exponentially decaying. Such an exponential decay of the amplitude envelope creates a chiming or bell-like tone, clearly distinguishable from the constant tone of a smoke alarm or the like.

Pulse Limiting Timer

A third operational amplifier 92 controls the number of pulses or chimes of the piezoelectric transducer 78 by pulling down the voltage on the cathode of diode 36 at an appropriate point through a protection resistor 94 connected between the output of operational amplifier 92 and the cathode of diode 36. The non-inverting input of operational amplifier 92 connects to the junction of a timing capacitor 96 and a pull-down resistor 98, the latter of which also attaches to ground. The remaining end of timing capacitor 96 connects to $V_{cc}$. Thus, when the alarm voltage is first provided at terminal 16 and $V_{cc}$ rises to the zener voltage of thirty volts, the non-inverting input of operational amplifier 92 is pulled high and its output follows to a high value.

The inverting input of operational amplifier 92 is connected to the junction of resistors 54 and 56 as previously described. The waveform 103 at this junction (shown in FIG. 2) rises and falls in time with the waveform 58 also shown in FIG. 2, the latter being the output of operational amplifier 50. The voltage at the non-inverting input slowly decays as capacitor 96 is discharged through resistor 98 as shown by waveform 101 in FIG. 2.

The chiming of the piezoelectric transducer 78 will cease when waveform 101 drops below waveform 103 and the output of operational amplifier 92 goes negative. The shallow slope of waveform 101 as it intersects waveform 103 ensures that the intersection will be at a point in time when waveform 103 is high and hence the output of operational amplifier 50 is high and there is no chiming. Thus the chiming will not be interrupted during a chime.

This communication between the pulse limiting timer 31 provided by amplifier 92, capacitor 96 and resistor 98, and the pulse generating oscillator 67 provided by operational amplifier 50 and its associated components, eliminates the possibility of a partial pulse or tone being produced by the piezoelectric transducer 78 such as might have little decay in amplitude causing it to sound like a conventional piezoelectric device in a smoke alarm or the like, or as if there were a malfunction in the circuitry.

Figure 3:
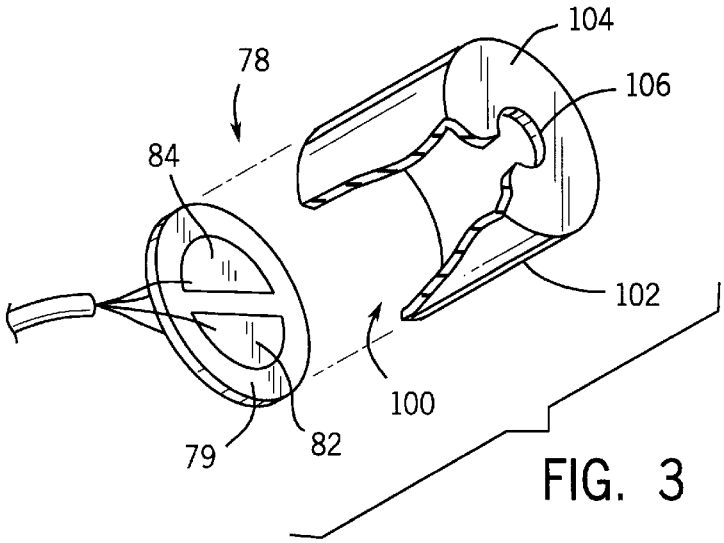
FIG. 3 is an exploded cutaway view of a piezoelectric transducer and its receiving resonant cavity housing.

Referring now to FIG. 3, the piezoelectric element 79 of the piezoelectric transducer 78 is disk-shaped, to be received at an open end 100 of a generally cylindrical housing 102. The piezoelectric element 79 forms one base of a cylindrical volume enclosed by the housing 102. The opposite base 104 includes a port 106 to permit sound generated by the piezoelectric element 79 to escape. The volume and dimensions of the cavity formed by the housing 102 with the piezoelectric element 79 will define a resonant cavity having a resonant frequency.

In the present invention, the housing 102 is sized so that its resonant frequency is approximately 10% less than the resonant frequency of the piezoelectric element 79 in free air as determined by operating the piezoelectric transducer 78 in its natural resonant frequency through the operation of operational amplifier 68. The result of this frequency mismatch between the natural resonant frequency of the cavity formed by housing 102 and the free air resonance of the piezoelectric transducer 78 is to add additional distinguishing color to the sound produced by the piezoelectric transducer 78, further differentiating it from conventional household appliances with alarms.

The above description has been that of a preferred embodiment of the present invention. It will occur to those that practice the art that many modifications may be made without departing from the spirit and scope of the invention. In order to apprise the public of the various embodiments that may fall within the scope of the invention, the following claims are made:

We claim:

1. An alarm for a clothes dryer having a dryer basket in which clothes to be dried can be tumbled during a tumbling cycle, the alarm comprising:

an electromechanical cycle timer controlling duration of the tumbling cycle;

a clothes dry signal generator providing a line voltage electrical alarm signal prior to the conclusion of the tumbling cycle;

a piezoelectric audio transducer; and a solid state transducer control circuit receiving the electrical alarm signal to provide a predetermined number of audio frequency pulses to the piezoelectric audio transducer, the pulses having decaying amplitude to produce a chime-like sound;

the solid state transducer control further including:

(i) solid state timing circuitry operating at a voltage level below line voltage;

(ii) a non-inductive voltage dropping element connected between the electrical alarm signal and the low voltage solid state timing circuitry reducing the voltage of the electrical alarm signal in proportion to the current flow therethrough to the voltage level of the solid state timing circuitry.

2. The alarm of claim 1 wherein the piezoelectric audio transducer includes a piezoelectric element and a resonator housing, the piezoelectric element having a free air natural resonant frequency and the resonant housing when assembled with the piezoelectric element providing a cavity having a resonant frequency different from the free air resonant frequency of the piezoelectric element.

3. The alarm of claim 2 wherein the resonant frequency of the cavity is lower than the free air resonant frequency of the piezoelectric element.

4. The alarm of claim 2 wherein the solid state transducer control circuit receives a feedback signal from the piezoelectric element to permit the solid state transducer control circuit to drive the piezoelectric element at a natural resonant frequency of the piezoelectric element.

5. The wrinkle preventing alarm of claim 1 wherein the alarm signal is a switched line voltage from the dryer.

6. The alarm for a clothes dryer claimed in claim 5 wherein the solid state control circuitry derives operating power from the alarm signal so as to be unpowered when no alarm signal is present.

7. The alarm of claim 1 wherein the solid state transducer control circuit includes a pulse generating oscillator providing a stream of audio frequency pulses to the piezoelectric audio transducer and a pulse limiting timer deactivating the pulse generating oscillator after the predetermined number of pulses, wherein the pulse limiting timer monitors the pulse generating oscillator to deactivate the pulse generating oscillator between pulses eliminating partial pulses.

8. In a clothes dryer having a dryer basket in which clothes to be dried can tumble during a tumbling cycle, the dryer having an electromechanical cycle timer controlling duration of the tumbling cycle producing a clothes dry signal providing a line voltage electrical alarm prior to the conclusion of the tumbling cycle, an alarm comprising:

a piezoelectric audio transducer; and a solid state transducer control circuit receiving the electrical alarm signal to provide a number of audio frequency pulses to the piezoelectric audio transducer, and the solid state transducer control further including:

(i) solid state timing circuitry operating at a voltage level below line voltage;

(ii) a non-inductive voltage dropping element connected between the electrical alarm signal and the low voltage solid state timing circuitry reducing the voltage of the electrical alarm signal in proportion to the current flow therethrough to the voltage level of the solid state timing circuitry.

* * * * *